US007226713B2

(12) United States Patent
Yamashita et al.

(10) Patent No.: US 7,226,713 B2
(45) Date of Patent: Jun. 5, 2007

(54) CARRIER, DEVELOPER INCLUDING THE CARRIER AND IMAGE FORMING APPARATUS USING THE DEVELOPER

(75) Inventors: Masahide Yamashita, Numazu (JP); Satoshi Mochizuki, Numazu (JP); Tomio Kondou, Numazu (JP); Kohsuke Suzuki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 204 days.

(21) Appl. No.: 10/766,874

(22) Filed: Jan. 30, 2004

(65) Prior Publication Data

US 2004/0253528 A1 Dec. 16, 2004

(30) Foreign Application Priority Data

Jan. 31, 2003 (JP) ..... 2003-025291

(51) Int. Cl.
*G03G 9/113* (2006.01)

(52) U.S. Cl. ..... 430/111.33; 430/111.41

(58) Field of Classification Search ..... 430/111.33, 430/111.41

See application file for complete search history.

(56) References Cited

U.S. PATENT DOCUMENTS

| | | | | |
|---|---|---|---|---|
| 5,595,850 | A * | 1/1997 | Honjo et al. | 430/111.33 |
| 5,849,448 | A | 12/1998 | Yoshino et al. | |
| 6,090,517 | A * | 7/2000 | Tamura et al. | 430/111.33 |
| 6,363,229 | B1 | 3/2002 | Shiraishi et al. | |
| 6,406,826 | B1 | 6/2002 | Suzuki et al. | |
| 6,503,676 | B2 | 1/2003 | Yamashita et al. | |
| 6,566,026 | B2 | 5/2003 | Watanabe et al. | |
| 6,630,276 | B2 | 10/2003 | Sugiura et al. | |
| 6,653,037 | B2 | 11/2003 | Sawada et al. | |
| 6,716,561 | B2 | 4/2004 | Shiraishi et al. | |
| 2002/0172884 | A1* | 11/2002 | Kayamoto et al. | 430/111.41 |

FOREIGN PATENT DOCUMENTS

| | | |
|---|---|---|
| JP | 54-155048 | 12/1979 |
| JP | 57-40267 | 3/1982 |
| JP | 57-168255 | 10/1982 |
| JP | 58-108548 | 6/1983 |
| JP | 58-108549 | 6/1983 |
| JP | 58-184157 | 10/1983 |
| JP | 59-166968 | 9/1984 |
| JP | 60-131549 | 7/1985 |
| JP | 1-19584 | 4/1989 |
| JP | 02-79862 | 3/1990 |
| JP | 3-120460 | 5/1991 |
| JP | 4-145451 | 5/1992 |
| JP | 5-8424 | 1/1993 |
| JP | 05-273789 | 10/1993 |
| JP | 6-202381 | 7/1994 |
| JP | 8-6307 | 1/1996 |
| JP | 8-6308 | 1/1996 |
| JP | 2683624 | 8/1997 |
| JP | 9-269614 | 10/1997 |
| JP | 9-311504 | 12/1997 |
| JP | 10-198078 | 7/1998 |
| JP | 10-239913 | 9/1998 |
| JP | 2000-5621 | 1/2000 |
| JP | 2000-15126 | 1/2000 |
| JP | 2998633 | 1/2000 |
| JP | 2000-107626 | 4/2000 |
| JP | 2000-137352 | 5/2000 |
| JP | 2000-338708 | 12/2000 |
| JP | 2001-117287 | 4/2001 |
| JP | 2001-117288 | 4/2001 |
| JP | 2001-188388 | 7/2001 |
| JP | 2002-296846 | 10/2002 |

OTHER PUBLICATIONS

U.S. Appl. No. 08/845,449, filed Apr. 30, 2001, unknown.
U.S. Appl. No. 09/826,789, filed Apr. 5, 2001, Suzuki et al.
U.S. Appl. No. 10/020,925, filed Dec. 19, 2001, Mochizuki et al.
U.S. Appl. No. 10/059,240, filed Jan. 31, 2002, Sugiura et al.
U.S. Appl. No. 10/059,239, filed Jan 31, 2002, Mochizuki et al.
U.S. Appl. No. 10/079,878, filed Feb. 22, 2002, Katoh et al.
U.S. Appl. No. 10/086,415, filed Mar. 4, 2002, Sugiura et al.
U.S. Appl. No. 10/101,756, filed Mar. 21, 2002, Matsuda et al.
U.S. Appl. No. 10/102,629, filed Mar. 22, 2002, Sawada et al.
U.S. Appl. No. 10/107,157, filed Mar. 28, 2002, Masuda et al.
U.S. Appl. No. 10/135,377, filed May 1, 2002, Yamaguchi et al.
U.S. Appl. No. 10/153,627, filed May 24, 2002, Suzuki et al.

(Continued)

*Primary Examiner*—Christopher Rodee
(74) *Attorney, Agent, or Firm*—Oblon, Spivak, McClelland, Maier & Neustadt, P.C.

(57) ABSTRACT

A carrier including a magnetic core material and a layer located on a surface of the magnetic core material, wherein the carrier satisfies the following relationships (1) to (3): $0.90 \leqq (\sigma a/\sigma b) < 1.00$ (1); $200 \leqq (\sigma b \cdot \rho c) \leqq 400$ (2); $10 \leqq (\sigma b/\rho c) \leqq 20$ (3), wherein $\sigma b$ represents a magnetization of the carrier at 1,000 Oe, $\sigma a$ represents a magnetization of the carrier after frictionized with a cylindrical sleeve under a specific condition and $\rho c$ represents a true specific gravity of the carrier, wherein the carrier has a weight-average particle diameter of about 25 to about 65 μm and includes carrier particles having a weight-average particle diameter not greater than about 12 μm in an amount of not greater than about 0.3% by weight, wherein a ratio between the weight-average particle diameter and a number-average particle diameter of the carrier is about 1 to about 1.3, and wherein an electric resistance is from about $1.0 \times 10^9$ to about $1.0 \times 10^{11}$ Ω·cm when an AC voltage represented by the following formula (4) is applied at a frequency of 1,000 Hz to a magnetic brush of the carrier is formed between parallel plate electrodes having a gap of d mm such that magnetic brush has a space occupancy of 40%: $E(V) = 250 \times d$ (4), wherein d is 0.40±0.05 mm and E is a peak voltage.

16 Claims, 2 Drawing Sheets

OTHER PUBLICATIONS

U.S. Appl. No. 10/176,578, filed Jun. 24, 2002, Yagi et al.
U.S. Appl. No. 10/212,736, filed Aug. 7, 2002, Sugiura et al.
U.S. Appl. No. 10/253,491, filed Sep. 25, 2002, Kondou et al.
U.S. Appl. No. 10/318,109, filed Dec. 13, 2002, Sugiura et al.
U.S. Appl. No. 10/385,719, filed Mar. 12, 2003, Sugiura et al.
U.S. Appl. No. 10/391,575, filed Mar. 20, 2003, Suzuki et al.
U.S. Appl. No. 10/609,399, filed Jul. 1, 2003, Katoh et al.
U.S. Appl. No. 11/558,736, filed Nov. 10, 2006, Uchinokura, et al.
U.S. Appl. No. 11/608,521, filed Dec. 8, 2006, Satoru, et al.

* cited by examiner

CARRIER, DEVELOPER INCLUDING THE CARRIER AND IMAGE FORMING APPARATUS USING THE DEVELOPER

BACKGROUND OF THE INVENTION

1. Field of the Invention

The present invention relates to a carrier that frictionally charges a toner, a two-component developer including at least the toner and carrier, and an image forming apparatus using the developer.

2. Discussion of the Background

In a conventional electrophotographic image forming method, an electrostatic latent image is formed on an image bearer formed of a photoconductive material, etc. and a charged toner adheres to the electrostatic latent image to visualize the latent image. After the visualized image with the toner is transferred onto a transfer medium, such as paper, it is fixed on the transfer medium with heat, pressure, or a solvent gas to become a produced image.

The methods of charging toner are broadly classified as (1) a two-component developing method wherein the toner and carrier are stirred and mixed to charge the toner; and (2) a one-component developing method wherein the toner is charged without the carrier. Further, whether magnetism is used to bear the toner particles on a developing roller classifies the one-component developing method to a magnetic one-component developing method or a non-magnetic one-component developing method.

The two-component developing method has been used in printers, copiers, and other complex machines requiring high-speed printing and good image reproducibility to comply with demands for charging stability and rising edge of the toner, and long-term stability of the resultant image quality. On the other hand, the one-component developing method is mostly used in small printers and facsimiles requiring space and cost savings.

Particularly in these days, colorization of images makes progress and demands for high quality images and stability of image quality are increasing.

Japanese Laid-Open Patent Publication No. 58-184157 and Japanese Patent Publication No. 5-8424 describe a two-component developing method using a magnetic carrier, wherein the carrier has a small particle diameter in accordance with a small particle diameter of the toner and more exquisite fuzz of a developer brush on a magnetic sleeve (developing sleeve) to develop a higher quality latent image.

However, when the magnetic carrier has a small particle diameter, magnetization per one carrier particle is small and a magnetic binding force thereof onto the magnetic sleeve becomes small. Therefore, carrier transfer, i.e., carrier adhesion onto the image bearer occasionally occurs.

To prevent carrier adhesion resulting from the small particle diameter of the magnetic carrier, in developing methods of feeding a developer by rotating a magnet included in a developing sleeve, Japanese Laid-Open Patent Publication No. 2000-137352 describes a method of setting a lower limit of the carrier saturation magnetization, and Japanese Laid-Open Patent Publication No. 2000-338708 describes a method of setting a lower limit of a product between a particle diameter and a residual magnetization of the magnetic carrier.

In other words, these methods prevent feeding the carrier having a small magnetic binding force before the feeding occurs. However, as an electrostatic element is added to the carrier in the image developer, a desorption force thereof is occasionally higher than the binding force and carrier adhesion cannot sufficiently be prevented.

In Japanese Laid-Open Patent Publication No. 2000-137352, a saturation magnetization in an electric field of 10,000 Oe is used. However, such a high electric field is not used in conventional electrophotographic image developers, and carrier adhesion cannot always be sufficiently prevented even when this method is used.

Japanese Laid-Open Patent Publication No. 4-145451 describes a method of removing carrier particles having a specific low saturation magnetization, a small particle diameter, and a small specific gravity, regardless of their particle diameters to prevent carrier adhesion. However, in Japanese Laid-Open Patent Publication No. 4-145451, the final properties of the carrier are not clarified at all, and sufficient prevention of carrier adhesion cannot be expected at present when further uniformity of the carrier particles is demanded.

Japanese Laid-Open Patent Publication No. 2002-296846 describes a method of specifying a volume-average particle diameter, a particle diameter distribution, an average air-space particle, a magnetization in a magnetic filed of 1,000 Oe of a core material of a carrier, and a magnetization difference between the carrier and scattered materials to prevent carrier adhesion. It can be supposed that the method of Japanese Laid-Open Patent Publication No. 2002-296846 has a specific prevention effect for the carrier adhesion because it prevents the presence of particles having a small magnetic binding force. However, as carrier adhesion depends on not only a magnetic binding force but also on a balance between the magnetic binding force and a sum of a mechanical and an electrostatic desorption force of the carrier particles, carrier adhesion occurs according to developing conditions only when the magnetic binding force is controlled. When a carrier having a comparatively large particle diameter is used (so as not to substantially include particles having a particle diameter greater than 12 μm), a developer brush formed on the developing sleeve (magnetic sleeve) remains fixed as it is for a long time.

Further, in Japanese Laid-Open Patent Publication No. 2002-296846, properties of a carrier core material are controlled to prevent the carrier adhesion and have other effects. However, as the carrier properties largely depend on mechanical, chemical, electrical, physical, and thermal properties of a coated layer of the carrier besides the properties of the core material, controlling only the core material properties does not always sufficiently control the carrier properties. Particularly, as image quality and stability thereof largely depend on properties of carrier surface when actually used in an image forming apparatus, carrier particles having a coated layer need to be used for better image quality.

Recently, in consideration of environmental protection, units using one-component developing method are mostly recycled and reused. At the same time, two-component developers are required to have higher longevities.

On the other hand, for decreasing energy consumption, a toner image fixing temperature is further decreasing, and the toner is easily deformed and firmly fixed at a lower temperature.

The two-component developers deteriorate because of: (1) carrier surface abrasion; (2) separation of a coated layer on the carrier surface; (3) carrier crush; and (4) deterioration of the chargeability, transfer from a desired electric resistance of the carrier, and generation of foreign particles such as broken pieces and abrasion powders accompanied by fixation (spent) of a toner on the carrier. These cause image quality deterioration, such as deterioration of image density, foggy background, and deterioration of image resolution. Deterioration, such as occurrence of physical and electrical damage of the image bearers, also occurs.

Many suggestions having some benefit have been made to solve the above-mentioned problems and to improve durability of the carrier.

As one suggestion paying attention to a coated layer of a coated carrier, i.e., a carrier having a coated layer on a surface of its core material, Japanese Laid-Open Patent Publication No. 8-6308 describes a carrier having a coated layer which is a hardened polyimide varnish including specific bimaleimide to improve stability against environment, and to prevent foggy background and separation of the coated layer. As another proposal, Japanese Patent No. 2998633 describes a carrier having a resin coated layer wherein a matrix resin includes dispersed resin particles and electroconductive fine particles to prevent the toner from becoming spent for a long time. Japanese Laid-Open Patent Publication No. 9-311504 describes a carrier having a coated layer formed of a phenol resin including a hardened amino group on a surface of a spheric complex core particulate material formed of an iron oxide powder and a phenol resin, wherein contents of the iron oxide powder and the amino group are specified to obtain a stable frictional charge and durability. Japanese Laid-Open Patent Publication No. 10-198078 describes a carrier having a coated layer formed of a matrix resin including dispersed resin fine particles and electroconductive fine particles, wherein the matrix resin includes not less than 10% of components of a binder resin of the toner to decrease an influence of the remaining spent toner on the chargeability of the carrier. Finally, Japanese Laid-Open Patent Publication No. 10-239913 describes a carrier having a coated layer formed of a polyimide resin having a repetition group including a diorganosiloxy group and a compound including two or more epoxy groups in a molecule to have a stable charged amount.

However, these suggestions do not achieve sufficient effects at present when the fixing temperature further decreases and higher longevity of the carrier is expected. In Japanese Laid-Open Patent Publication No. 8-6308, Japanese Patent No. 2998633 and Japanese Laid-Open Patent Publication Nos. 9-311504 and 10-239913, the matrix resin occupies most of the carrier surface alone and the toner fixation mostly depends on the surface status of the matrix resin. Therefore, sufficient improvement of preventing toner from becoming spent is not achieved. In Japanese Laid-Open Patent Publication No. 10-198078, when a toner having a low temperature fixability is used, components on the surface of the carrier that are the same as those of the toner binder resin tend to be a base point of the toner fixation, and the toner is occasionally not stably charged from the beginning of the toner agitation.

Many suggestions of forming a coated layer with a silicone resin having comparatively a low surface energy have also been made. However, the silicone resin has a problem of deficient adherence to a core material of the carrier due to the low surface energy.

Japanese Laid-Open Patent Publication No. 58-108548 describes a carrier coated with a specific resin; Japanese Laid-Open Patent Publications Nos. 57-40267, 58-108549, 59-166968 and 6-202381 and Japanese Patent Publication No. 1-19584 describe carriers coated with specific resins including various additives; and Japanese Patent No. 3120460 describes a carrier coated with the specific resin and an additive is adhered on the surface thereof. Japanese Laid-Open Patent Publication No. 8-6307 describes a carrier mainly coated with a benzoguanamine-n-butylalcohol-formaldehyde copolymer. Japanese Patent No. 2683624 describes a carrier coated with a cross-linked resin between a melamine resin and an acrylic resin. However, these carriers do not yet have sufficient durability.

To improve charged amount instability of the carrier accompanied by the spent toner on the surface thereof and resistance variation due to an abrasion of the coated resin, Japanese Laid-Open Patent Publications Nos. 2001-117287, 2001-117288 and 2001-188388 describe a carrier coated with a thermoplastic resin and a carrier coated with the thermoplastic resin having a larger particle diameter than that of the binder resin.

Japanese Laid-Open Patent Publication No. 9-319161 describes a method of dispersing fine particles of a specific thermoplastic resin in the matrix resin of the coated layer as another method of maintaining the coated layer properties of the carrier, particularly the chargeability thereof. By this method, even an abraded coated layer has equivalent properties to those of the initial coated layer. However, the method does not sufficiently decrease abrasion.

Even the method in Japanese Patent No. 2998933, wherein an electroconductive fine powder is dispersed at the same time in addition to the specific thermoplastic resin, does not sufficiently decrease the abrasion.

As mentioned above, trials of fundamentally improving the carrier adhesion in a two-component developer expected to produce high quality images in order to stably produce high quality images have not been made so far with a concept that various binding forces and desorption forces applied to the carrier particles in image developers should be within proper ranges, and this still remains a difficult problem. Further, preventing carrier adhesion and abundantly and softly forming or properly renewing a developer brush on a developing sleeve to properly feed the toner onto an electrostatic latent image bearer and produce high quality images with a high density and without background fouling still remain a difficult problem.

Because of these reasons, a need exists for a carrier producing high quality images without carrier adhesion and having good durability.

SUMMARY OF THE INVENTION

Accordingly, an object of the present invention is to provide a carrier producing high quality images without carrier adhesion and having good durability.

Another object of the present invention is to provide a two-component developer including the carrier.

Still another object of the present invention is to provide an image developer, an image forming apparatus, and a process cartridge using the two-component developer.

Briefly these objects and other objects of the present invention as hereinafter will become more readily apparent can be attained by a carrier including a magnetic core material and a layer located on a surface of the magnetic core material, wherein the carrier satisfies the following relationships (1) to (3):

$$0.90 \leqq (\sigma a/\sigma b) < 1.00 \quad (1)$$

$$200 \leqq (\sigma b \cdot \rho c) \leqq 400 \quad (2)$$

$$10 \leqq (\sigma b/\rho c) \leqq 20 \quad (3)$$

wherein σb represents a magnetization (emu/g) of the carrier at 1,000 Oe, ρc represents a true specific gravity of the carrier, and σa represents a magnetization of the carrier determined by the following method including:

(1) magnetically holding the carrier on a cylindrical sleeve having a magnetic pole area which is located over a magnetic pole and which has a peak magnetic flux density of 100 mT in a direction perpendicular to an axis of the cylindrical sleeve;

(2) rotating the cylindrical sleeve around the axis thereof for about 30 min;

(3) removing the carrier from the magnetic pole area by applying a force which is three times as much as the gravity of the carrier in the direction perpendicular to the axis of the cylindrical sleeve; and (4) measuring a magnetization at 1,000 Oe to determined the magnetization σa, wherein the carrier has a weight-average particle diameter (D4) of about 25 to about 65 μm and includes carrier particles having a weight-average particle diameter not greater than 12 μm in an amount of not greater than about 0.3% by weight, wherein a ratio (D4/D1) between the weight-average particle diameter (D4) and a number-average particle diameter of the carrier (D1) is about 1 to about 1.3, and wherein an electric resistance R is about $1.0\times10^{9}$ to about $1.0\times10^{11}$ Ω·cm when an AC voltage represented by the following formula (4) is applied at a frequency of 1,000 Hz to a magnetic brush of the carrier is formed between parallel plate electrodes having a gap of d mm such that magnetic brush has a space occupancy of about 40%:

$$E(V)=250\times d \quad (4)$$

wherein d is 0.40±0.05 mm and E is a peak voltage.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
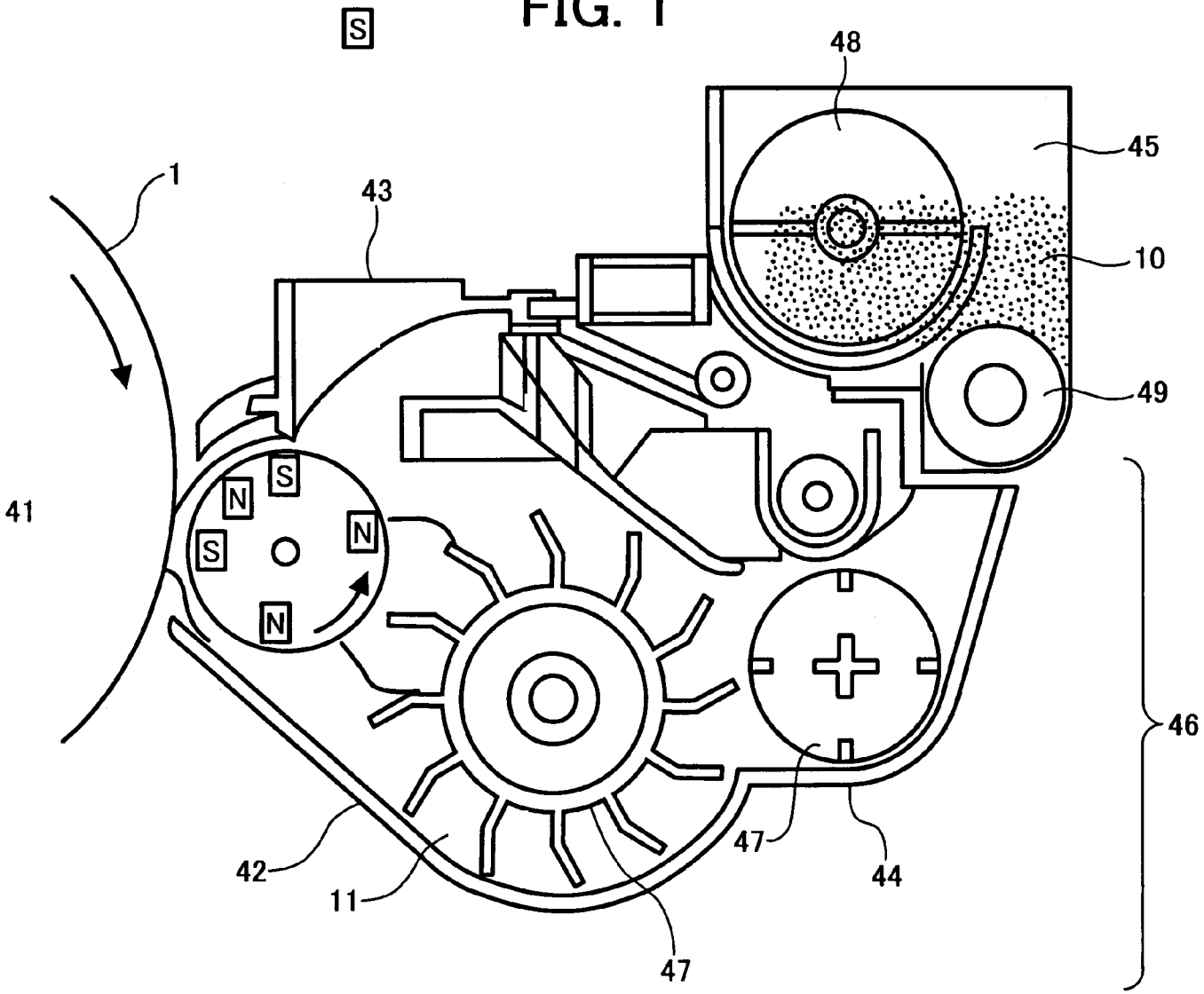
FIG. 1 is a schematic view illustrating a principal part of the image developer of the present invention.

Generally, the present invention provides a carrier producing high quality images without carrier adhesion and having good durability.

As a result of continued studies of the present inventors, it was discovered that a carrier including a core material and a layer coated on a surface of the core material, which satisfies the following conditions 1 to 5, prevents carrier adhesion and improves image quality.

Condition 1: when a magnetization of the carrier at 1,000 Oe is σb emu/g and a magnetization of the carrier at about 1,000 Oe, which is magnetically held on a cylindrical sleeve, and which desorbs from an opening which is an area having a peak magnetic flux density of about 100 mT in a direction perpendicular to an axis of the cylindrical sleeve is rotated for about 30 min and a desorption force which is about three times as much as gravity is applied in the direction perpendicular to the axis of the cylindrical sleeve is σa emu/g, a magnetization ratio (σa/σb) satisfies the following formula (1):

$$0.90\leqq(\sigma a/\sigma b)<1.00 \quad (1).$$

Condition 2: the magnetization σb and a true specific gravity of the carrier σc g/cm$^3$ satisfy the following formulae (2) and (3):

$$200\leqq(\sigma b\cdot\rho c)\leqq400 \quad (2)$$

$$10\leqq(\sigma b/\rho c)\leqq20 \quad (3).$$

Condition 3: the carrier has a weight-average particle diameter (D4) of about 25 to about 65 μm, and a content of the carrier having the weight-average particle diameter not greater than 12 μm is not greater than about 0.3% by weight.

Condition 4: a ratio (D4/D1) between the weight-average particle diameter (D4) and number-average particle diameter of the carrier (D1) is about 1 to about 1.3.

Condition 5: an electric resistance R is about $1.0\times10^{9}$ to about $1.0\times10^{11}$ Ω·cm when a volt alternating current (VAC) E having the following formula (4) is applied at a frequency of 1,000 Hz to a magnetic brush of the carrier having a space occupancy of about 40%, which is formed between parallel plate electrodes having a gap of d mm:

$$E(V)=250\times d \quad (4),$$

wherein d is 0.40±0.05 mm and E is a peak voltage.

The reasons can be supposed as follows. First, carrier adhesion occurs when a desorption force mostly from electrostatic force due to a developing electric field is larger than a magnetic binding force of the carrier particles onto a magnetic sleeve, a magnetic brush is cut and the carrier particles transfer onto an image bearer. Therefore, to decrease carrier adhesion, a formation of a weak binding force portion in the magnetic brush should be prevented.

It is supposed that the weak binding force portion in the magnetic brush is caused by low-magnetized carrier particles which are mixedly present with all the other carrier particles.

Namely, it can be considered that a magnetization of the desorbed carrier that could not be held by the magnetic binding force is related to a ratio (a weight ratio or a weighed weight with the magnetization) of the low-magnetized carrier particles included in the original carrier. Therefore, in the present invention, it is discovered that a magnetization ratio between the desorbed carrier and the original carrier needs to be within the above-mentioned range.

When many low-magnetized carrier particles are present, many weak binding force portions mentioned above are formed and the magnetization of the desorbed carrier including the low-magnetized carrier particles. When (σa/σb) is less than about 0.9, it is difficult to maintain a sufficient magnetic binding force while controlling a harness of the magnetic brush. These are preferably verified in an electrophotographic image forming apparatus actually used or a similar apparatus modified to have conditions more severe than a normal image forming apparatus. This is same for the other conditions 2 to 5.

Various causes of the presence of the low-magnetized carrier, such as a particle diameter distribution thereof (presence of fine powder carrier) and variation of the carrier composition, can be supposed. In any case, carrier desorption is uniquely considered as a magnetization ratio.

To simply and reliably obtain the desorbed carrier, a carrier is put in an image developer having a developing sleeve having a specific magnetic flux density in its developing area and carrier desorption is performed for a predetermined time while changing a rotating speed of the sleeve to obtain a desired desorption force.

In the second place, when a specific gravity and a magnetization of the carrier are too unbalanced, all the carriers probably cause carrier adhesion. Additionally, a magnetic brush formed on a developing sleeve is hardened, which prevents a toner from being smoothly fed to an electrostatic latent image bearer and damages the electrostatic latent image bearer, regardless of the magnetization ratio of the present invention. Therefore, it is discovered that the magnetization σb and a true specific gravity of the carrier ρc g/cm$^3$ should satisfy the following formulae (2) and (3):

$$200 \leqq (\sigma b \cdot \rho c) \leqq 400 \quad (2)$$

$$10 \leqq (\sigma b / \rho c) \leqq 20 \quad (3)$$

When (σb·ρc) is less than about 200, a magnetization per a unit volume is so low that a magnetic binding force of the carrier becomes weak and carrier adhesion tends to occur. When greater than about 400, the magnetic brush tends to be hardened to prevent a toner from being smoothly fed to the electrostatic latent image bearer to cause deterioration of image density, which damages the electrostatic latent image bearer to make it difficult to establish developing conditions to produce high quality images while effectively preventing carrier adhesion.

When (σb/ρc) is less than about 10, magnetizations of individual carrier particles become small. When greater than about 30, uneven magnetizations of individual carrier particles tend to occur. Therefore, carrier adhesion is not sufficiently prevented and high quality images are not produced.

In the third place, it is discovered that the carrier should have a weight-average particle diameter (D4) of about 25 to about 65 μm, and a content of the carrier having the weight-average particle diameter not greater than about 12 μm is not greater than about 0.3% by weight.

As mentioned above, the carrier preferably has a small particle diameter to produce high quality images. However, carrier particles having too small a particle diameter have a small magnetization and a small binding force individually. Therefore, the carrier needs to have a weight-average particle diameter (D4) of about 25 to about 65 μm to prevent carrier adhesion and produce high quality images. For the same reason, carrier adhesion can reliably be prevented when a content of the carrier having the weight-average particle diameter not greater than about 12 μm is not greater than about 0.3% by weight.

In the fourth place, when a particle diameter distribution of the carrier is sharp and uniform, specifically when a ratio (D4/D1) between the weight-average particle diameter (D4) and number-average particle diameter of the carrier (D1) is from about 1 to about 1.3, the individual carrier particles have more uniform magnetizations, carrier adhesion can be further be decreased, and wide developing conditions can be used to produce high quality images. When D4/D1 is greater than about 1.3, the particle diameter distribution of the carrier is broad and a magnetization unevenness of the individual carrier particles becomes large. When the carrier having a large particle diameter increases, even a small number thereof largely increases D4/D1, and the carrier having a large particle diameter impairs a formation of a proper developing brush and tends to form a hardened developer brush. Although even a large number of the carrier having a small particle diameter does not largely increase D4/D1, when a ratio of the carrier having a small particle diameter increases, an electric field capable of sufficiently binding the carrier having a small magnetization needs to be formed. Therefore, a binding force of the carrier particles having a large magnetization becomes too strong and it becomes difficult to form a magnetic brush having a proper hardness. Deterioration of the carrier particles is also accelerated because an excessive stress is applied to the carrier particles.

In the fifth place, it is discovered that an electric resistance R should be between about $1.0\times10^9$ to about $1.0\times10^{11}$ Ω·cm when a volt alternating current (VAC) E having the following formula (4) is applied at a frequency of 1,000 Hz to a magnetic brush of the carrier having a space occupancy of about 40%, which is formed between parallel plate electrodes having a gap of d mm:

$$E(V) = 250 \times d \quad (4),$$

wherein d is 0.40±0.05 mm and E is a peak voltage.

As mentioned above, as carrier adhesion is caused by a balance between a magnetic binding force and a mechanical and electrostatic desorption force of the carrier particles, an electrostatic regulation of the carrier is preferred to prevent the carrier adhesion (in addition to the magnetic regulations and particle diameter regulations thereof in the conditions 1 to 4).

When the electric resistance R is greater than about $1.0\times10^{11}$ Ω·cm, a charge generated by frictionally charged toner and carrier due to agitation of a developer is accumulated in the carrier particles, and the carrier particles are drawn to an non-image forming section of an image bearer to cause carrier adhesion.

When the electric resistance R is less than about $1.0\times10^9$ Ω·cm, the carrier particles have induced charges and carrier adhesion occurs regardless of an image forming section or a non-image forming section.

Further, the carrier having a low electric resistance disturbs an electrostatic latent image on an image bearer and impairs high quality images.

Therefore, in the present invention, when the respective carrier properties are within the above-mentioned ranges, carrier adhesion can be prevented and high quality images can be produced in wide developing conditions.

A surface roughness of the carrier preferably has a difference of elevation of about 0.1 to about 2.0 μm, and more preferably about 0.2 to about 1.0 μm to ensure abrasion and spent resistance of a coated layer of the carrier and to prevent a variation of the properties with time of the carrier, particularly the charging capability and/or resistance. When the surface roughness of the carrier preferably has a difference of elevation of about 0.1 to about 2.0 μm, a change with time of an electrostatic force applied to the carrier as a desorption force in a developing section is prevented and carrier adhesion can be prevented even after many images are produced.

Insulative inorganic particles are preferably used for the carrier particles. Specific non-limiting examples of the insulative inorganic particles include known insulative powder particles such as: aluminum oxide, silicon oxide, sodium carbonate, talc, clay, quartz glass, alumino silicate glass, mica chip, zirconium oxide, mullite, sialon, steatite, forsterite, cordierite, beryllium oxide and silicon nitride. However, the insulative inorganic particles are not limited thereto. Particularly, the insulative inorganic particles preferably include an aluminium atom constituent and/or a silicon atom constituent typified by the aluminium oxide and silicon oxide to further prevent desorption of the particles from the coated layer and to more reliably prevent a change of the carrier resistance with time.

To surely form concavity and convexity due to the particles on a surface of the carrier, a content of the particles is preferably about 50 to about 95%, and more preferably about 55 to about 80% by weight per 100% by weight of the constituents of the coated layer.

When the content of the particles is less than about 50% by weight, the concavity and convexity on the surface of the carrier tends to be gentle and occasionally does not sufficiently scrape spent toner. On the other hand, when the content of the particles is greater than about 95%, the concavity and convexity tends to be brittle and the initial concavity and convexity occasionally cannot be maintained.

Specific examples of the resins forming the coated layer of the carrier are not particularly limited and include cross-linked copolymers such as polyolefin such as polyethylene and polypropylene and their modified resins, styrene, acrylic resins, acrylonitrile, vinylacetate, vinylalcohol, vinylcarbazole and vinylether; silicone resins formed of an organosiloxane bond or its modified resins by alkyd resins, polyester resins, epoxy resins, polyurethane, etc.; polyamide; polyester; polyurethane, polycarbonate; urea resins; melamine resins; benzoguanamine resins; epoxy resins; polyimide resins; and their derivatives.

Particularly, the resin in the coated layer preferably includes an acrylic section as a constitutional unit to reliably fix the insulative inorganic particles in the coated layer and to effectively prevent desorption thereof due to friction. The acrylic section in the coated layer can quite effectively prevent the desorption of the inorganic particles due to friction and can maintain the concavity and convexity on the surface of the carrier for a long time. Further, the acrylic resin preferably has a glass transition temperature of about 20 to about 100° C., and more preferably about 25 to about 80° C. The acrylic resin having a glass transition temperature in the above-mentioned range has a moderate elasticity, and it is considered that an impact the carrier receives when the developer is frictionally charged is decreased to prevent damage to the coated layer.

Further, the resin in the coated layer is preferably a cross-linked resin between an acrylic resin and an amino resin to prevent a fusion bond of the resins to each other (i.e., a blocking tending to occur when only the acrylic resin is used) while maintaining moderate elasticity.

Specific non-limiting examples of the amino resins include known amino resins. Particularly, guanamine resins and melamine resins are preferably used to improve charging capability of the carrier. When the charging capability needs to be properly controlled, other amino resins may be used together with the guanamine resins and/or melamine resins, for example.

Further, the resin in the coated layer preferably includes a silicone section as a constitutional unit to decrease a surface energy of the carrier and prevent occurrence of the spent toner. Therefore, the carrier properties can be maintained for a long time.

The constitutional unit of the silicone section preferably includes a unit selected from the group including: methyltrisiloxane units, dimethyldisiloxane units, and trimethylsiloxane units. The silicone portion may be chemically bonded, blended, or multilayered with the other resin in the coated layer. When multilayered, the silicone section is preferably located at an uppermost surface of the layer.

When blended and multilayered, silicone resins and/or its modified resins are preferably used. Specific non-limiting examples of the silicone resins include any known silicone resins. Particularly, thermosetting silicone resins capable of having a three-dimensional network structure, straight silicone only formed of an organosiloxane bond having the following formula (1) and silicone resins modified by alkyd, polyester, epoxy urethane are preferably used:

(1)

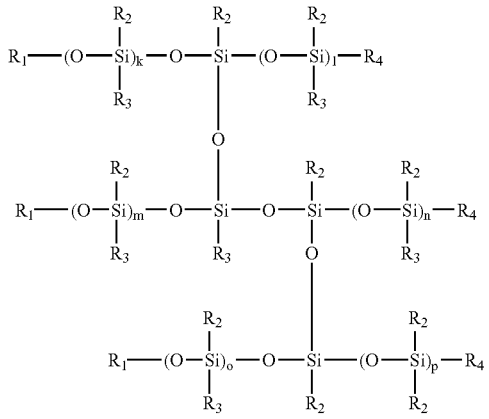

wherein $R_1$ represents a hydrogen atom, an alkyl group having 1 to 4 carbon atoms or a phenyl group; $R_2$ and $R_3$ independently represent a hydrogen atom, an alkoxy group having 1 to 4 carbon atoms, a phenyl group, a phenoxy group, an alkenyl group having 2 to 4 carbons atoms, an alkenyloxy group having 2 to 4 carbon atoms, a hydroxy group, a carboxyl group, an ethyleneoxide group, a glycidyl group or a group having the following formula (2):

(2)

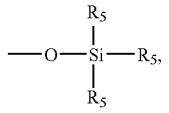

wherein $R_4$ and $R_5$ independently represent a hydroxy group, a carboxyl group, an alkyl group having 1 to 4 carbon atoms, an alkoxy group having 1 to 4 carbon atoms, an alkenyl group having 2 to 4 carbon atoms, an alkenyloxy group having 2 to 4 carbon atoms, a phenyl group and a phenoxy group; and k, 1, m, n, o, and p independently represent integers.

Each of the above-mentioned substitutes may be unsubstituted and may have substitutes such as (as non-limiting examples) a hydroxy group, a carboxyl group, an alkyl group, a phenyl group, and a halogen atom.

The coated layer preferably includes conductive or semiconductive particles having a smaller number-average particle diameter than that of the particles forming surface concavities and convexities, typified by the above-mentioned insulative inorganic particles to precisely control the carrier resistance.

Known conductive or semiconductive particles can be used. Specific non-limiting examples of the conductive particles include metals such as iron, gold and copper; iron oxide such as ferrite and magnetite; oxides such as bismuth oxide and molybdenum oxide; ionic conductors such as silver iodide and β-alumina; and pigments such as carbon black. Specific non-limiting examples of the semiconductive particles include double oxides such as barium titanate, strontium titanate and lead lanthanum titanate; titanium oxide; zinc oxide; oxygen defect formations of tin oxide (Frankel type semiconductors); and impurity type defect formations (Schottky type semiconductors).

Among these conductive or semiconductive particles, particularly a furnace black and an acetylene black are preferably used, because even a small amount of low-resistance fine powders thereof can effectively control the conductivity.

The low-resistance fine powders need to be smaller than the particles forming surface concavities and convexities of a carrier, and preferably have a number-average particle diameter of about 0.01 to about 1 μm and a content of about 2 to about 30 parts by weight per 100 parts by weight of the resin in the coated layer.

Known methods can be used to form the coated layer, and a coating liquid for forming the coated layer can be coated on a surface of the core material particle by spray coating methods, dip coating methods, or the like. The coated layer preferably has a thickness of about 0.01 to about 20 μm, and more preferably from about 0.3 to about 10 μm.

The carrier particle on which the coated layer is formed is preferably heated to promote a polymerization reaction of the coated layer.

The carrier may be heated in a coating apparatus or other heating means such as ordinary electric ovens and sintered kiln after the coated layer is formed.

The heating temperature cannot be completely determined because it differs depending on the material used in the coated layer, but a temperature of about 120 to about 350° C. is preferably used. The heating temperature is preferably not greater than a decomposition temperature of a resin for use in the coated layer and preferably has an upper limit of about 200° C. In addition, a heating time is preferably about 5 to about 120 min.

Magnetic materials for use in the core material of the carrier are not particularly limited, and known materials, e.g., metals such as iron, cobalt and nickel; alloyed metals such as magnetite, hematite and ferrite; and other compounds can be used. However, the materials are not limited thereto.

The magnetic particles may be used in any forms of a single crystal/amorphous particles, a single/complex sintered body and particles including single/complex particles dispersed in a polymer such as resins. Particles including magnetic particles in a polymer preferably have magnetic particles having a particle diameter of about 0.5 to about 10 μm to balance magnetic properties of the carrier particles and dispersibility of the magnetic particles. Specific non-limiting examples of resins including dispersed magnetic particles and forming a carrier core material include: polyolefin resins such as polyethylene, polypropylene, chlorinated polyethylene and chlorosulfonated polyethylene; polyvinyl and polyvinylidene resins such as polystyrene, acrylic resins, e.g., polymethylmethacrylate, polyacrylonitrile, polyvinylacetate, polyvinylalcohol, polyvinylbutyral, polyvinylchloride, polyvinylcarbazole, polyvinylether and polyvinylketone; vinylchloride-vinylacetate copolymers; fluorocarbon resins such as polytetrafluoroethylene, polyfluorovinyl, polyfluorovinylidene and polychlorotrifluoroethylene; polyamide; polyester; polyurethane; polycarbonate, etc. However, the resins are not limited thereto.

Particles including core materials including dispersed magnetic materials may include a coupling agent such as silane coupling agents and titanate coupling agents as an auxiliary agent to improve adhesion of the magnetic materials and dispersibility of a resistance controlling agent. However, the particles are not limited thereto.

Ferrite particles are preferably used as the magnetic core materials to control magnetizations of individual carrier particles. Particles including a resin in which magnetic materials are dispersed are preferably used as the magnetic core materials to control shapes of the particles and impart other properties thereto, while maintaining the specified magnetization ratio. However, the particles are not limited thereto.

An electrophotographic developer including an electrophotographic carrier which is the above-mentioned electrophotographic carrier and a toner including at least a binder resin and a colorant can prevent carrier adhesion and produce high quality images. The toner is preferably about 2 to about 12%, and more preferably about 2.5 to about 10% by weight in the developer.

The magnetic core material for the carrier of the present invention can be prepared by effectively controlling a process of preparing the core material.

For example, a manganese ferrite typically has a random spinel structure because the manganese and an iron element have a comparatively close ion radius, and therefore a tetrahedral hole and an octahedral hole formed by a closet packing of an oxygen atom are randomly occupied by the manganese atom and iron atom.

It is considered that magnetic properties of the manganese and iron elements tend to strongly appear in such a randomly occupied condition because a magnetic operation due to a lattice structure comparatively weakens. Therefore, it can be considered that a nonuniformity of the metallic element compositions of the individual carrier particles directly affects the magnetic properties of the carrier particles.

Accordingly, to prepare a magnetic core material for use in the present invention, it is essential that uniformity of the compositions is elevated. For example, it is preferable to see that materials for the magnetic core are sufficiently pulverized and dispersed, that the pulverized and dispersed materials are pre-burned for a controlled time and at a controlled temperature, and that the pre-burned materials are sufficiently pulverized and dispersed.

Besides, for core material particles in which a magnetic material is dispersed, it is preferable to see a content and a dispersibility of magnetic particles dispersed in a polymer, and to control conditions of forming the core material particles so as to form as few vacant spaces as possible therein.

Any electrophotographic toners can be used without particular limit in the present invention.

Specific non-limiting examples of the binder resins for use in the electrophotographic toners include: styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; acrylic ester polymers and copolymers such as polymethylacrylate, polybutylacrylate, polymethylmethacrylate and polybutylmethacrylate; polyvinyl derivatives such as polyvinylchloride and polyvinylacetate; polyester polymers; polyurethane polymers; polyamide polymers; polyimide polymers; polyol polymers; epoxy polymers; terpene polymers; aliphatic or alicycle hydrocarbon resins; aromatic petroleum resins; etc. These can be used alone or in combination, but the resins are not limited thereto. Among these resins, at least a resin selected from the group including styrene-acrylic copolymer resins, polyester resins and polyol resins is preferably used to impart good electrical properties to the resultant toner and to decrease production cost thereof. Further, polyester resins and/or polyol resins are more preferably used to impart good fixability to the resultant toner.

Known pigments and dyes used as colorants for toners can be used as colorants in the electrophotographic toner of the present invention. Specific non-limiting examples of the colorants include carbon black, lamp black, iron black, cobalt blue, nigrosin dyes, aniline blue, phthalocyanine blue, phthalocyanine green, Hansa Yellow G, Rhodamine 6C Lake, chalco oil blue, chrome yellow, quinacridone red, benzidine yellow, rose Bengal, etc. These can be used alone or in combination.

The toner particles may optionally include a magnetic constituent, e.g., iron oxides such as ferrite, magnetite and maghematite; and metals such as iron, cobalt and nickel or their alloyed metals with other metals, etc. alone or in combination to have magnetic properties. These can be used as a colorant or used together with a colorant.

The toner included in the electrophotographic developer preferably includes a release agent to perform an oilless fixation (without using a fixing oil). Waxes such as polyethylene wax, propylene wax, and carnauba wax (as non-limiting examples) are preferably used as the release agent included in the toner, but the release agents are not limited thereto. A content of the release agent is preferably about 0.5 to about 10.0%, and more preferably about 3.0 to about 8.0% by weight, depending on the release agent and a fixing method for the resultant toner.

Known additives can be used to improve fluidity and resistance against environment of the resultant toner. Specific non-limiting examples of the additive include inorganic powders and the hydrophobized inorganic powders such as zinc oxide, tin oxide, aluminium oxide, titanium oxide, silicon oxide, strontium titanate, valium titanate, calcium titanate, strontium zirconate, calcium zirconate, lanthanum titanate, calcium carbonate, magnesium carbonate, mica and dolomite. These can be used alone or in combination. As the other additives, fine particles of fluorocarbon resins such as polytetrafluoroethylene, tetrafluoroethylene-hexafluoropropylene copolymers and polyfluorovinylidene may be used to improve toner surface. These additives may be externally added to the toner particles in an amount of about 0.1 to about 10 parts by weight per 100 parts by weight of the toner particles, but may vary based on the additive. The additives may optionally be mixed in a mixer to adhere or agglutinate on the surface of the toner, or to be free among the toner particles.

Besides, as charge controlling agents improving chargeability of the resultant toner, known non-limiting examples of charge controlling agents, e.g., positive charge controlling agents such as vinyl copolymers including an amino group, quaternary ammonium salt compounds, nigrosin dyes, polyamine resins, imidazole compounds, azine dyes, triphenylmethane dyes, guanidine compounds and lake pigments; and negative charge controlling agents such as carboxylic acid derivatives, metallic salts of the carboxylic acid, alkoxylate, organic metal complexes and chelate compounds can be used alone or in combination. These can be kneaded and/or added in toner particles. The controlling agents preferably have a dispersed particle diameter not greater than about 0.2 μm, and more preferably not greater than about 1.0 μm when dispersed in the toner particles to evenly generate an interaction with a surface of a carrier.

The toner particles in the developer of the present invention can be prepared by kneading the materials as mentioned above with known non-limiting methods using a two-roll, a biaxial extruding kneader, a uniaxial extruding kneader, etc. and pulverizing and classifying the kneaded materials with known mechanical or airstream methods. Dispersants may be used together to control dispersing status of the colorant and magnetic materials in kneading. Further, the toner particles may include the above-mentioned additives mixed by mixers, etc. to improve surfaces thereof.

A polymerized toner prepared by granulating toner particles with starting materials such as resin monomers and low-molecular-weight resin oligomers can also be used.

Charged amounts of the toner particles cannot categorically be determined because of being different depending on the practical use process. However, the toner particles in combination with the carrier particles of the present invention preferably have a saturated charge amount of about 3 to about 40 μc/g, and more preferably about 5 to about 30 μc/g in numerical value.

The toner particles preferably have a weight-average particle diameter of about 4 to about 10 μm, and a number basis 10% particle diameter not less than about 2.5 μm to produce images having a stable image quality.

In an image developer having a frictional charger charging a toner by frictionizing a developer; a rotatable holder holding the developer including the charged toner and a magnetic field generator inside; and an image bearer forming an electrostatic latent image, when the developer is the developer of the present invention and a magnetic flux density B (mT) in a normal direction of a surface of the holder close to a developing area which is a close contact position between the holder and the image bearer satisfies the relationship represented by the following formula (5):

$$15{,}000/(\sigma a\cdot\rho c)\leqq B\leqq 50{,}000/(\sigma b\cdot\rho c) \quad (5),$$

magnetic binding force can be maintained for particles having a low magnetization, which are mixed in the carrier, and a magnetic brush of the carrier in the developing section can be controlled in good condition. Therefore, carrier adhesion can be prevented and high quality images can be produced for a long time.

The image developer preferably has a retainer keeping a distance between the image bearer and developer holder of about 0.30 to about 0.80 mm when closest to each other in the developing area to stably develop. When the distance is less than about 0.30 mm, the magnetic brush occasionally cleans a developed toner image up. When greater than 0.80 mm, toners are developed more on an edge of a solid image than on a center thereof, i.e., an edge effect tends to occur.

The image developer preferably has a voltage applicator applying a DC bias voltage to the image bearer when producing a halftone image by mainly changing a ratio of a developing area per unit area. In addition, the image developer preferably has a voltage applicator applying a bias voltage, wherein an AC voltage is overlapped with a DC voltage to the developer holder when producing a halftone image by mainly changing an adhesion amount of the toner per unit area.

The image developer is preferably equipped with a toner recycler including at least a cleaner cleaning the image bearer and a collected toner transporter transporting a toner collected by the cleaner to a developing section of the image developer to save resources.

When an image forming apparatus including a transferer transferring respective toner images formed on image bearers of plural image developers onto a medium and a fixer fixing the toner image thereon has the above-mentioned image developers, the image forming apparatus produces high quality images while preventing the carrier adhesion.

In a process cartridge having a frictional charger charging a toner by frictionizing a developer; a rotatable holder holding the developer including the charged toner and a magnetic field generator inside; an image bearer forming an electrostatic latent image; and a developer including a toner, when the developer is the developer of the present invention and a magnetic flux density B (mT) in a normal direction of a surface of the holder close to a developing area which is a close contact position between the holder and the image bearer satisfies the relationship represented by the formula (5), the process cartridge can stably develop for a long time without decreasing the carrier in the developer due to carrier adhesion.

Hereinafter, the image developer of the present invention will be explained, referring to the drawings.

FIG. 1 is a schematic view illustrating a principal part of the image developer of the present invention. An image developer facing a photoreceptor drum 1, which is a latent image bearer, is mainly constituted of a developing sleeve 41 bearing a developer, a developer containing member 42, a doctor blade 43, and a support case 44. The support case 44 has an opening in the direction of the photoreceptor drum 1 is combined with a toner hopper 45 as a toner container containing a toner 10. A developer container 46 containing a developer 11 formed of the toner 10 and carrier particles, which is adjacent to the toner hopper 45, is equipped with a developer stirrer 47 for stirring the toner and carrier particles, and for imparting a friction/separation charge to the toner particles.

The toner hopper 45 is equipped with a toner agitator 48 rotated by a driver (not shown) and includes a toner feeder 49 inside. The toner agitator 48 and toner feeder 49 feed the toner 10 in the toner hopper 45 toward the developer container 46 while agitating the toner 10.

The developing sleeve is arranged in a space between the photoreceptor drum 1 and the toner hopper 45. The developing sleeve 41 rotated by a driver (not shown) in a direction indicated by an arrow has, for example, a magnet (not shown) as a magnetic field generator inside, which is fixedly located in a relative position to an image developer, to form a magnetic brush with the carrier particles.

The doctor blade 43 is fitted in a body to an opposite side of the developer containing member 42 to the side on which the support case 44 is fitted. The doctor blade 43 is located so as to keep a regular clearance between an end thereof and a peripheral surface of the developing sleeve 41.

The toner 10 fed by the toner agitator 48 and toner feeder 49 from the toner hopper 45 is transported to the developer container 46, where the developer stirrer 47 stirs the toner to impart a desired friction/separation charge thereto. Then, the toner 10 is borne by the developing sleeve 41 with the carrier particles (or alone) as the developer 11 and transported to a position facing a peripheral surface of the photoreceptor drum 1, where only the toner 10 is electrostatically combined with a latent image formed on the photoreceptor drum 1 to form a toner image thereon.

Figure 2:
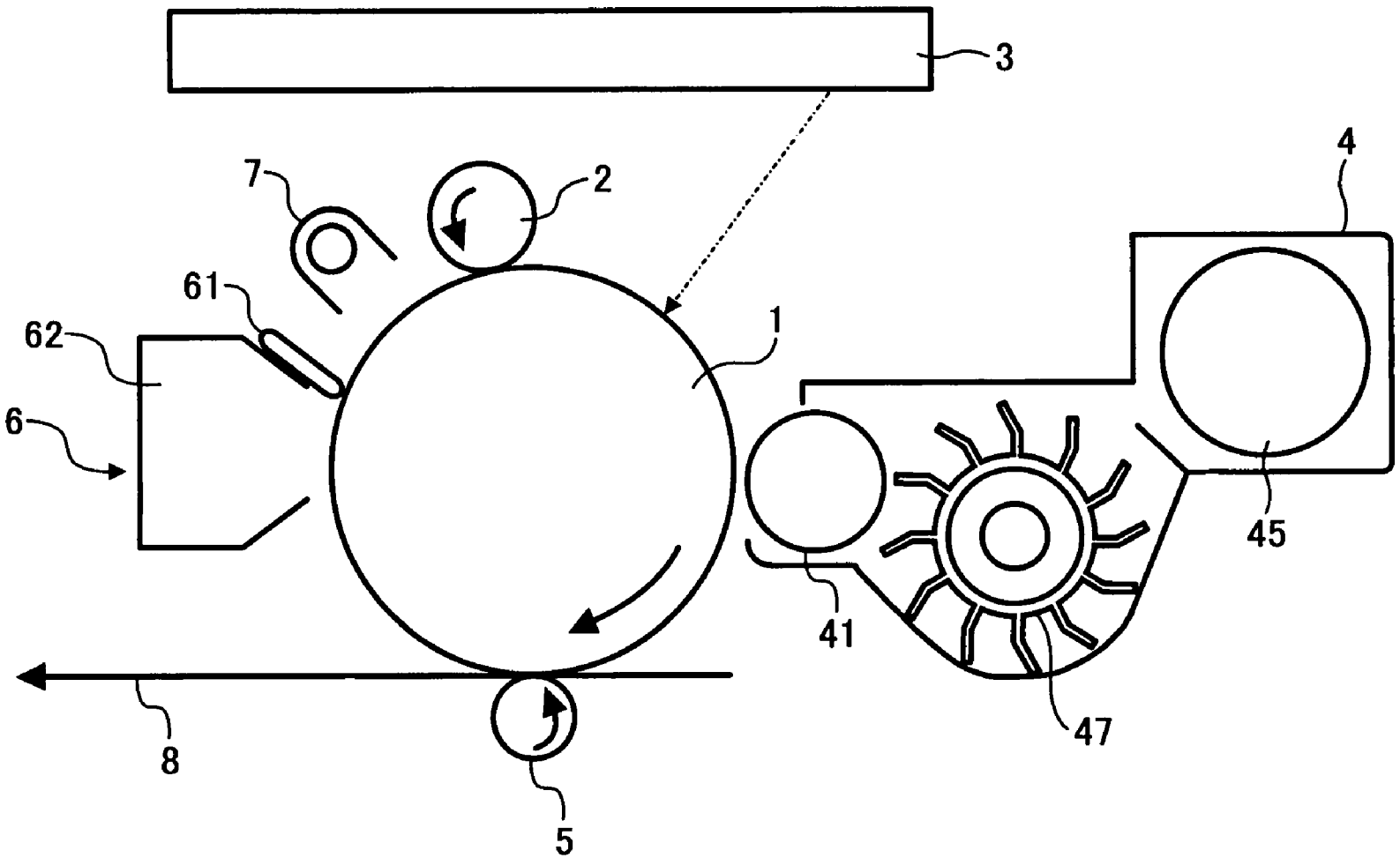
FIG. 2 is a schematic view illustrating an embodiment of an image forming apparatus including the image developer of the present invention.

FIG. 2 is a schematic view illustrating an embodiment of an image forming apparatus including the image developer of the present invention. Around a drum-shaped image bearer 1, a charging member for the image bearer 2, an image irradiator 3, an image developer 4, a transferer 5, a cleaner 6, and a discharge lamp are arranged, and an image is formed as follows.

A negative and positive image forming process will be explained. The image bearer 1 typified by a photoreceptor (OPC) having an organic photoconductive layer is discharged by the discharge lamp 7 and negatively and uniformly charged by the charging member 2 {such as chargers and charging rollers). Then, a laser beam emitted from the irradiator 3 irradiates the image bearer to form a latent image thereon (irradiated part potential is lower than that of a non-irradiated part).

The laser beam is emitted from a laser diode and a polyangular polygon mirror rotating at a high speed reflects the beam to scan a surface of the image bearer 1 in a direction of a rotation axis thereof. Then, the latent image is developed with the developer formed of the toner particles or a mixture of the toner particles and the carrier particles, which is fed on the developing sleeve 41 which is a developer bearer in the image developer to form a visual toner image. When the latent image is developed, a voltage applicator (not shown) applies an appropriate voltage between the irradiated part and non-irradiated part of the image bearer or applies a developing bias in which an AC voltage is overlapped with the voltage to the developing sleeve 41.

On the other hand, a transfer medium (such as papers 8) is synchronously fed from a paper feeder (not shown) to a clearance between the image bearer 1 and the transferer 5 with a top and bottom pair of resist rollers (not shown) with a front edge of an image, and the toner image is transferred on the transfer medium. A transfer bias applied to the transferer is preferably a potential having a reverse polarity to a polarity of the toner charge. Then, the transfer medium or an intermediate transfer medium 8 is separated from the image bearer 1 to have a transferred image.

The toner particles remaining on the image bearer are collected with a cleaning member 61 in a toner collection space 62 in the cleaner 6.

The collected toner particles may be transported by a toner recycler (not shown) to the image developer and/or the toner feeder and used again.

The image forming apparatus may have plural image developers mentioned above, sequentially transfer plural toner images on a transfer medium and transport the transfer medium to a fixer to fix the toner image thereon with a heat, etc., or may transfer the plural toner images on an intermediate transfer medium once, transfer the plural toner images together on a transfer medium, and fix the toner images.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Manganese oxide and iron oxide were mixed at a molar ratio (Mn/Fe) of 30/70. After the mixture was pulverized and dispersed by a ball mill in water in a wet pulverizing and dispersing method for 48 hrs, the mixture was dried and pre-burned at 850° C. for 1 hr in a weak reduction atmosphere.

The wet pulverization was performed by filling zirconia balls having a diameter of 10 mm in a ball mill pot by 30% by volume of the ball mill pot capacity and a oxide slurry including a solid content of 25% by volume thereof.

The pre-burned mixture was pulverized and dispersed again by a ball mill in water in a wet pulverizing and dispersing method for 24 hrs to prepare a slurry of manganese and iron complex oxide.

Polyvinylalcohol and a dispersant were added to the slurry as a binder, and the slurry was granulated and dried by a spray drier, and then classified by an supersonic vibration sieve to prepare granulated particles.

The granulated particles were burned at 1,200° C. for 4 hrs in a weak reduction atmosphere to prepare manganese ferrite particles.

Further, the manganese ferrite particles were classified by the supersonic vibration sieve to prepare a core material (1).

The following materials were dispersed by a homomixer for 30 min to prepare a coating liquid for forming a coated layer.

| | |
|---|---|
| Acrylic rein solution having a solid content of 50% by weight | 60 |
| Guanamine solution having a solid content of 70% by weight | 15 |
| Straight silicone resin having a solid content of 20% | 150 |
| Dibutyltin diacetate | 1.5 |
| Alumina particles having a number-average particle diameter of 0.3 μm | 100 |
| Carbon black | 6 |
| Toluene | 1,500 |

After this coating liquid was coated on the core material (1) by a fluidized-bed spray coater the coated core material was heated in an atmosphere having a temperature of 150° C. for 1 hr to prepare a carrier (C1).

A particle diameter distribution of the carrier (C1) was measured by a particle diameter distribution measurer Model X100® from Microtrac Inc. to find that the carrier (C1) had a weight-average particle diameter (D4) of 36.5 μm, a number-average particle diameter (D1) of 34.3 μm, and that a content of the carrier particles having a particle diameter not greater than 12 μm was 0.09% by weight.

A true specific gravity ρc of the carrier (C1) was measured by a Beckman aerometer to find that it was 5.1 (g/cm$^3$).

A surface of the carrier (C1) was observed by a scanning electron microscope at 2000-fold magnification to find that concavities and convexities of alumina were formed, and an average vertical interval of the concavities and convexities on the surface thereof measured by a laser microscope without contacting the surface was 0.3 μm.

A magnetization (σb) of the carrier (C1) at 1,000 Oe measured by a multi-sample rotational magnetization measurer REM-1-10® from TOEI INDUSTRY CO., LTD. was 65 emu/g.

A desorption test of the carrier (C1) was performed as follows.

First, as a developing sleeve for test, a developing sleeve of a color printer IPSio color 8000® from Ricoh Company, Ltd. was modified such that the developing pole had a peak magnetic flux density of 100 mT.

Next, the developing sleeve for test was installed in a developing unit, a rotation number of the sleeve was controlled by a motor prepared separately such that a centrifugal force (desorption force) was 3 times as much as the gravity (the developing sleeve diameter was 18 mm, and the rotation number thereof was $\{3\times9.8\ (m/s^2)\times0.009\ (m)\}^{1/2}\times1{,}000\ (mm)/\{18\ (mm)\times\pi\}\times60\ (sec)=546$ rpm).

250 g of the carrier (C1) were put in the developing unit and the developing sleeve was continuously rotated for 30 min to collect the desorbed carrier from an opening of a developing area of the developing unit.

A magnetization (σa) of the desorbed carrier collected at 1,000 Oe was 63 emu/g.

The following materials were kneaded by a two-roll kneader for 30 min, and the kneaded mixture was pulverized and classified by a mechanical pulverizer and an airstream classifier to prepare a mother toner.

| | |
|---|---|
| Partially cross-linked polyester resin (A condensation polymer of an adduct alcohol of bisphenol A with ethylene oxide, an adduct alcohol of bisphenol A with propylene oxide, a terephthalic acid and trimellitic acid, having a weight-average molecular weight of 15,000 and a glass transition temperature of 61° C.) | 79.5 |
| Carbon black | 15 |
| Zirconium salt of Di-tert-butyl salicylate | 1 |
| Carnauba wax from CERARICA NODA Co., Ltd. | 5 |

Further, each 1 part of a hydrophobic silica fine particles and a hydrophobic titanium oxide fine particles were added to 100 parts of the mother toner, and the mixture was mixed by a Henschel mixer for 2 min to prepare a toner (T1).

A particle diameter distribution of the toner (T1) was measured by Coulter counter TA2® to find that the toner (T1) had a weight-average particle diameter D4 of 6.2 μm, and a number basis 10% particle diameter, which was derived from an accumulated number, of 2.5 μm.

Next, 920 parts of the carrier (C1) and 80 parts of the toner (T1) were mixed by a tubular mixer for 1 min to prepare a two-component developer.

300,000 copies of an A4 original having an image area ratio of 6% were continuously produced by a color printer IPSio color 8000® from Ricoh Company, Ltd. with the two-component developer. Image qualities of the initial image and the image after 300,000 copies were produced of a letter image, a halftone image, and a solid image were evaluated.

Then, the developing pole had a magnetic flux density of 110 mT and a minimum distance between the developing sleeve and the photoreceptor in the developing section was 0.6 mm.

An electrostatic latent image on the image bearer had a potential of −700 V at the background and −200 V at the image area when the image was produced. A developing bias in which a DC voltage of −500 V was overlapped with an AC voltage having a voltage between the peaks of 1,500 V and a frequency of 2,000 Hz was applied to the developing sleeve.

Whether the blank image and solid image had carrier adhesion, the letter was fattened, the half tone image had a surface roughness, other defects, and gradient of the halftone image and stability of the image density of the solid image were evaluated.

Both the initial images and images after 300,000 copies had good image qualities, and therefore the carrier of the present invention can effectively be used for the image quality and life.

The image density was measured by Macbeth densitometer RD-914® and the other items were visually evaluated.

The evaluation results of each initial image and image after 300,000 copies were produced are shown in Tables 1-1, 1-2, 1-3, and 1-4.

Example 2

The procedures for preparation and evaluation of the two-component developer in Example 1 were repeated to prepare a two-component developer except for changing the molar ratio (Mn/Fe) from 30/70 to 10/90 and burning the granulated particles at 1,250° C. instead of 1,200° C. to prepare a core material.

Example 3

The procedures for preparation and evaluation of the two-component developer in Example 1 were repeated to prepare a two-component developer except for changing the molar ratio (Mn/Fe) from 30/70 to 50/50 to prepare a core material.

Example 4

The procedures for preparation and evaluation of the two-component developer in Example 1 were repeated to prepare a two-component developer except for using the following materials to prepare a core material.

| | |
|---|---|
| Adduct of dimethylenephenyl with bisallylnadiimide | 100 |
| Manganese ferrite powder having an average particle diameter of 4 μm | 800 |
| Carbon black | 20 |
| Toluene | 1,000 |

These materials were mixed, dispersed, granulated, and dried by a spray drier. Then, a resin in the mixture was hardened at 200° C. for 30 min, and the mixture was cooled and classified to prepare a core material in which the manganese ferrite magnetic powder was dispersed in an imide resin.

Example 5

The procedures for preparation and evaluation of the two-component developer in Example 4 were repeated to prepare a two-component developer, except for using a manganese magnesium strontium ferrite powder having an average particle diameter of 4.2 μm instead of the manganese ferrite powder having an average particle diameter of 4 μm to prepare a core material in which the manganese magnesium strontium ferrite magnetic powder was dispersed in an imide resin.

Example 6

The procedures for preparation and evaluation of the two-component developer in Example 1 were repeated to prepare a two-component developer, except for controlling the granulation conditions and the classifying conditions of the manganese ferrite particles with the supersonic vibration sieve after burned to prepare a core material having a slightly broad particle diameter distribution.

Example 7

The procedures for preparation and evaluation of the two-component developer in Example 1 were repeated to prepare a two-component developer, except for changing the parts of the carbon black for use in the coating liquid for the core material of the carrier from 6 to 7.5 to prepare a carrier.

Example 8

The procedures for preparation and evaluation of the two-component developer in Example 1 were repeated to prepare a two-component developer, except for changing the parts of the carbon black for use in the coating liquid for the core material of the carrier from 6 to 3 to prepare a carrier.

Example 9

The procedures for preparation and evaluation of the two-component developer in Example 1 were repeated to prepare a two-component developer, except for changing the parts of the alumina particles from 100 to 50 and carbon black for use in the coating liquid for the core material of the carrier from 6 to 4 to prepare a carrier.

Example 10

The procedures for preparation and evaluation of the two-component developer in Example 1 were repeated to prepare a two-component developer, except for not using the alumina particles and changing the parts of the carbon black for use in the coating liquid for the core material of the carrier from 6 to 1 to prepare a carrier.

Examples 11 and 12

The procedures for preparation and evaluation of the two-component developer in Example 1 were repeated to prepare a two-component developer, except for controlling the pulverizing and classifying conditions of the kneaded mixture to prepare a mother toner having a weight-average particle diameter of 11 μm (T2) and a mother toner having a weight-average particle diameter of 3.8 μm (T3).

Comparative Example 1

The procedures for preparation and evaluation of the two-component developer in Example 1 were repeated to prepare a two-component developer, except for pulverizing and dispersing the mixture of the manganese oxide and iron oxide by a ball mill in water in a wet pulverizing and dispersing method for 12 instead of 48 hrs to prepare a core material.

Comparative Example 2

The procedures for preparation and evaluation of the two-component developer in Example 1 were repeated to prepare a two-component developer, except for changing the molar ratio (Mn/Fe) from 30/70 to 3/97 and burning the granulated particles at 1,250° C. instead of 1,200° C. to prepare a core material.

Comparative Example 3

The procedures for preparation and evaluation of the two-component developer in Example 1 were repeated to prepare a two-component developer, except for changing the molar ratio (Mn/Fe) from 30/70 to 65/35 to prepare a core material.

Comparative Example 4

The procedures for preparation and evaluation of the two-component developer in Example 4 were repeated to prepare a two-component developer, except for using a magnetite powder having an average particle diameter of 4.1 μm instead of the manganese ferrite powder having an average particle diameter of 4 μm to prepare a core material in which the magnetite magnetic powder was dispersed in an imide resin.

Comparative Example 5

The procedures for preparation and evaluation of the two-component developer in Example 4 were repeated to prepare a two-component developer, except for using a copper zinc ferrite powder having an average particle diameter of 4.5 μm instead of the manganese ferrite powder having an average particle diameter of 4 μm to prepare a core material in which the copper zinc ferrite magnetic powder was dispersed in an imide resin.

Comparative Example 6

The procedures for preparation and evaluation of the two-component developer in Example 1 were repeated to prepare a two-component developer, except for controlling the granulation conditions and the classifying conditions of the manganese ferrite particles with the supersonic vibration sieve after burning to prepare a core material having a smaller average particle diameter.

Comparative Example 7

The procedures for preparation and evaluation of the two-component developer in Example 1 were repeated to prepare a two-component developer, except for controlling the granulation conditions and the classifying conditions of the manganese ferrite particles with the supersonic vibration sieve after burning to prepare a core material having a larger average particle diameter.

Comparative Example 8

The procedures for preparation and evaluation of the two-component developer in Example 1 were repeated to prepare a two-component developer, except for controlling the granulation conditions and the classifying conditions of the manganese ferrite particles with the supersonic vibration sieve after burning to prepare a core material having slightly a large amount of fine powder.

Comparative Example 9

The procedures for preparation and evaluation of the two-component developer in Example 1 were repeated to prepare a two-component developer, except for controlling the granulation conditions and the classifying conditions of the manganese ferrite particles with the supersonic vibration sieve after burning to prepare a core material having a broad particle diameter distribution.

Comparative Example 10

The procedures for preparation and evaluation of the two-component developer in Example 1 were repeated to prepare a two-component developer, except for changing the parts of the carbon black for use in the coating liquid for the core material of the carrier from 6 to 10 to prepare a carrier.

Comparative Example 11

The procedures for preparation and evaluation of the two-component developer in Example 1 were repeated to prepare a two-component developer, except for changing the parts of the carbon black for use in the coating liquid for the core material of the carrier from 6 to 1.5 to prepare a carrier.

Example 13

The procedures for preparation and evaluation of the two-component developer in Example 1 were repeated to prepare a two-component developer, except for mixing 850 parts of the carrier (C1) and 150 parts of the toner (T1) by a tubular mixer for 3 min instead of mixing 920 parts of the carrier (C1) and 80 parts of the toner (T1) by the tubular mixer for 1 mm.

Examples 14 and 15

The procedures for preparation and evaluation of the two-component developers in Examples 1 and 2 were repeated, except for modifying the developing sleeve so as to have a developing pole having a peak magnetic flux density of 140 mT.

Examples 16 and 17

The procedures for preparation and evaluation of the two-component developers in Examples 1 and 5 were repeated, except for modifying the developing sleeve so as to have a developing pole having a peak magnetic flux density of 70 mT.

Examples 18 and 19

The procedures for preparation and evaluation of the two-component developer in Examples 1 were repeated, except for changing the minimum distance between the developing sleeve and the photoreceptor in the developing section from 0.6 to 0.25 and 0.9 mm.

Example 20

The procedures for preparation and evaluation of the two-component developer in Examples 1 were repeated, except for applying only the DC voltage of −500 V as the developing bias instead of the DC voltage of −500 V overlapped with an AC voltage having a voltage between the peaks of 1,500 V and a frequency of 2,000 Hz.

TABLE 1-1

| | Carrier | | | | | |
|---|---|---|---|---|---|---|
| | Carrier magnetization σb (emu/g) | Desorbed carrier magnetization σa (emu/g) | σa/σb | Weight-average particle diameter (D4) (μm) | Number-average particle diameter (D1) (μm) | D4/D1 |
| Ex. 1 | 65 | 63 | 0.97 | 36.5 | 34.3 | 1.1 |
| Ex. 2 | 70 | 65 | 0.93 | 35.8 | 30.5 | 1.2 |
| Ex. 3 | 52 | 51 | 0.98 | 36.4 | 33.0 | 1.1 |
| Ex. 4 | 69 | 66 | 0.96 | 34.7 | 33.9 | 1.0 |
| Ex. 5 | 54 | 52 | 0.96 | 37.2 | 35.3 | 1.1 |
| Ex. 6 | 65 | 62 | 0.95 | 39.4 | 30.7 | 1.3 |
| Ex. 7 | 65 | 63 | 0.97 | 36.5 | 34.3 | 1.1 |
| Ex. 8 | 65 | 63 | 0.97 | 36.5 | 34.3 | 1.1 |
| Ex. 9 | 65 | 62 | 0.95 | 36.7 | 35.1 | 1.0 |
| Ex. 10 | 65 | 63 | 0.97 | 35.9 | 34.4 | 1.0 |
| Ex. 11 | 65 | 63 | 0.97 | 36.5 | 34.3 | 1.1 |
| Ex. 12 | 65 | 63 | 0.97 | 36.5 | 34.3 | 1.1 |
| Ex. 13 | 65 | 63 | 0.97 | 36.5 | 34.3 | 1.1 |
| Ex. 14 | 65 | 63 | 0.97 | 36.5 | 34.3 | 1.1 |
| Ex. 15 | 70 | 65 | 0.93 | 35.8 | 30.5 | 1.2 |
| Ex. 16 | 65 | 63 | 0.97 | 36.5 | 34.3 | 1.1 |
| Ex. 17 | 54 | 52 | 0.96 | 37.2 | 35.3 | 1.1 |
| Ex. 18 | 65 | 63 | 0.97 | 36.5 | 34.3 | 1.1 |
| Ex. 19 | 65 | 63 | 0.97 | 36.5 | 34.3 | 1.1 |
| Ex. 20 | 65 | 63 | 0.97 | 36.5 | 34.3 | 1.1 |
| Com. Ex. 1 | 65 | 54 | 0.83 | 36.7 | 35.1 | 1.0 |
| Com. Ex. 2 | 78 | 76 | 0.97 | 37.3 | 33.5 | 1.1 |
| Com. Ex. 3 | 50 | 49 | 0.98 | 34.9 | 32.1 | 1.1 |
| Com. Ex. 4 | 73 | 70 | 0.96 | 39.6 | 37.9 | 1.0 |
| Com. Ex. 5 | 44 | 42 | 0.95 | 36.2 | 33.9 | 1.1 |
| Com. Ex. 6 | 65 | 64 | 0.98 | 24.8 | 24.5 | 1.0 |
| Com. Ex. 7 | 65 | 63 | 0.97 | 67.0 | 62.4 | 1.1 |
| Com. Ex. 8 | 65 | 61 | 0.94 | 34.2 | 32.5 | 1.1 |
| Com. Ex. 9 | 65 | 62 | 0.95 | 38.4 | 27.9 | 1.4 |
| Com. Ex. 10 | 65 | 63 | 0.97 | 36.5 | 34.3 | 1.1 |
| Com. Ex. 11 | 65 | 63 | 0.97 | 36.5 | 34.3 | 1.1 |

TABLE 1-2

| | Carrier | | | | | | | |
|---|---|---|---|---|---|---|---|---|
| | 22 μm or less (% by wt.) | 12 μm or less (% by wt.) | 10 μm or less (% by wt.) | Specific gravity ρc (g/cm$^3$) | σb · ρc (emu/cm$^3$) | σb/ρc | Vertical interval between C on-cavity and convexity | Electric resistance (Ω · cm) |
| Ex. 1 | 0.3 | 0.09 | 0.06 | 5.1 | 331.5 | 12.7 | 0.3 | $1.1 \times 10^{10}$ |
| Ex. 2 | 0.5 | 0.15 | 0.10 | 5.2 | 364.0 | 13.5 | 0.3 | $5.2 \times 10^{9}$ |
| Ex. 3 | 0.4 | 0.12 | 0.08 | 5.2 | 270.4 | 10.0 | 0.3 | $3.4 \times 10^{10}$ |
| Ex. 4 | 0.2 | 0.06 | 0.04 | 3.6 | 248.4 | 19.2 | 0.3 | $9.7 \times 10^{9}$ |
| Ex. 5 | 0.3 | 0.09 | 0.06 | 3.8 | 205.2 | 14.2 | 0.3 | $7.6 \times 10^{10}$ |
| Ex. 6 | 0.8 | 0.24 | 0.17 | 5.1 | 331.5 | 12.7 | 0.3 | $3.8 \times 10^{10}$ |
| Ex. 7 | 0.3 | 0.09 | 0.06 | 5.1 | 331.5 | 12.7 | 0.2 | $1.3 \times 10^{9}$ |
| Ex. 8 | 0.3 | 0.09 | 0.06 | 5.1 | 331.5 | 12.7 | 0.3 | $8.5 \times 10^{10}$ |
| Ex. 9 | 0.2 | 0.06 | 0.04 | 5.1 | 331.5 | 12.7 | 0.05 | $6.5 \times 10^{9}$ |
| Ex. 10 | 0.4 | 0.12 | 0.08 | 5.1 | 331.5 | 12.7 | 0.3 | $7.2 \times 10^{9}$ |
| Ex. 11 | 0.3 | 0.09 | 0.06 | 5.1 | 331.5 | 12.7 | 0.3 | $1.1 \times 10^{10}$ |
| Ex. 12 | 0.3 | 0.09 | 0.06 | 5.1 | 331.5 | 12.7 | 0.3 | $1.1 \times 10^{10}$ |
| Ex. 13 | 0.3 | 0.09 | 0.06 | 5.1 | 331.5 | 12.7 | 0.3 | $1.1 \times 10^{10}$ |

TABLE 1-2-continued

| | Carrier | | | | | | | |
|---|---|---|---|---|---|---|---|---|
| | 22 μm or less (% by wt.) | 12 μm or less (% by wt.) | 10 μm or less (% by wt.) | Specific gravity ρc (g/cm$^3$) | σb · ρc (emu/cm$^3$) | σb/ρc | Vertical interval between C on-cavity and convexity | Electric resistance (Ω · cm) |
| Ex. 14 | 0.3 | 0.09 | 0.06 | 5.1 | 331.5 | 12.7 | 0.3 | $1.1 \times 10^{10}$ |
| Ex. 15 | 0.5 | 0.15 | 0.10 | 5.2 | 364.0 | 13.5 | 0.3 | $5.2 \times 10^{9}$ |
| Ex. 16 | 0.3 | 0.09 | 0.06 | 5.1 | 331.5 | 12.7 | 0.3 | $1.1 \times 10^{10}$ |
| Ex. 17 | 0.3 | 0.09 | 0.06 | 3.8 | 205.2 | 14.2 | 0.3 | $7.6 \times 10^{10}$ |
| Ex. 18 | 0.3 | 0.09 | 0.06 | 5.1 | 331.5 | 12.7 | 0.3 | $1.1 \times 10^{10}$ |
| Ex. 19 | 0.3 | 0.09 | 0.06 | 5.1 | 331.5 | 12.7 | 0.3 | $1.1 \times 10^{10}$ |
| Ex. 20 | 0.3 | 0.09 | 0.06 | 5.1 | 331.5 | 12.7 | 0.3 | $1.1 \times 10^{10}$ |
| Com. Ex. 1 | 0.3 | 0.09 | 0.06 | 5.1 | 331.5 | 12.7 | 0.3 | $1.9 \times 10^{10}$ |
| Com. Ex. 2 | 0.4 | 0.12 | 0.08 | 5.2 | 405.6 | 15.0 | 0.3 | $4.7 \times 10^{9}$ |
| Com. Ex. 3 | 0.4 | 0.12 | 0.08 | 5.1 | 255.0 | 9.8 | 0.3 | $3.6 \times 10^{10}$ |
| Com. Ex. 4 | 0.5 | 0.15 | 0.10 | 3.6 | 262.8 | 20.3 | 0.3 | $8.8 \times 10^{9}$ |
| Com. Ex. 5 | 0.5 | 0.15 | 0.10 | 3.8 | 167.2 | 11.6 | 0.3 | $9.2 \times 10^{10}$ |
| Com. Ex. 6 | 19.0 | 5.65 | 3.93 | 5.1 | 331.5 | 12.7 | 0.3 | $8.4 \times 10^{9}$ |
| Com. Ex. 7 | 0.0 | 0.00 | 0.00 | 5.1 | 331.5 | 12.7 | 0.3 | $2.7 \times 10^{10}$ |
| Com. Ex. 8 | 1.1 | 0.33 | 0.23 | 5.1 | 331.5 | 12.7 | 0.3 | $9.6 \times 10^{9}$ |
| Com. Ex. 9 | 0.9 | 0.27 | 0.19 | 5.1 | 331.5 | 12.7 | 0.3 | $9.1 \times 10^{9}$ |
| Com. Ex. 10 | 0.3 | 0.09 | 0.06 | 5.1 | 331.5 | 12.7 | 0.3 | $5.8 \times 10^{8}$ |
| Com. Ex. 11 | 0.3 | 0.09 | 0.06 | 5.1 | 331.5 | 12.7 | 0.3 | $2.3 \times 10^{11}$ |

TABLE 1-3

| | Initial Image Quality | | | | | |
|---|---|---|---|---|---|---|
| | Carrier adhesion | Letter fattening | Halftone image surface roughness | Gradient | Image density | Other defects |
| Ex. 1 | ◎ | ◎ | ◎ | ◎ | 1.42 | |
| Ex. 2 | ◎ | ◎ | ◎ | ○ | 1.44 | |
| Ex. 3 | ○ | ◎ | ◎ | ◎ | 1.40 | |
| Ex. 4 | ○ | ◎ | ◎ | ◎ | 1.39 | |
| Ex. 5 | ○ | ○ | ◎ | ◎ | 1.39 | |
| Ex. 6 | ○ | ◎ | ◎ | ○ | 1.41 | |
| Ex. 7 | ○ | ○ | ○ | ◎ | 1.44 | |
| Ex. 8 | ○ | ◎ | ◎ | ○ | 1.40 | |
| Ex. 9 | ◎ | ○ | ○ | ◎ | 1.41 | |
| Ex. 10 | ◎ | ○ | ○ | ○ | 1.40 | |
| Ex. 11 | ◎ | ◎ | ◎ | ○ | 1.43 | |
| Ex. 12 | ◎ | ○ | ◎ | ◎ | 1.39 | Slightly foggy background |
| Ex. 13 | ◎ | Δ | ◎ | ○ | 1.44 | Slight contamination in the apparatus |
| Ex. 14 | ◎ | ◎ | ◎ | ○ | 1.41 | |
| Ex. 15 | ◎ | ◎ | ◎ | Δ | 1.42 | |
| Ex. 16 | ○ | ◎ | ◎ | ◎ | 1.43 | |
| Ex. 17 | Δ | ○ | ◎ | ○ | 1.40 | |
| Ex. 18 | ○ | ◎ | ○ | ○ | 1.37 | |
| Ex. 19 | ○ | ◎ | ◎ | Δ | 1.36 | |
| Ex. 20 | ◎ | ○ | ◎ | ○ | 1.40 | |
| Com. Ex. 1 | X | ◎ | ◎ | ◎ | 1.40 | |
| Com. Ex. 2 | ◎ | Δ | ○ | Δ | 1.38 | |
| Com. Ex. 3 | X | Δ | ○ | ○ | 1.39 | |
| Com. Ex. 4 | X | ○ | X | ○ | 1.40 | |

TABLE 1-3-continued

| | Initial Image Quality | | | | | |
|---|---|---|---|---|---|---|
| | Carrier adhesion | Letter fattening | Halftone image surface roughness | Gradient | Image density | Other defects |
| Com. Ex. 5 | X | ○ | ○ | ○ | 1.42 | |
| Com. Ex. 6 | X | ○ | X | ○ | 1.35 | |
| Com. Ex. 7 | ◎ | ○ | ○ | X | 1.38 | Much foggy background |
| Com. Ex. 8 | X | ○ | ○ | ○ | 1.40 | |
| Com. Ex. 9 | X | ○ | ○ | ◎ | 1.39 | |
| Com. Ex. 10 | X | Δ | X | ○ | 1.39 | |
| Com. Ex. 11 | X | Δ | ◎ | Δ | 1.35 | |

◎: Very good
○: Practically usable
Δ: Acceptable
X: Unusable

TABLE 1-4

| | Image Quality after 300,000 images were produced | | | | | |
|---|---|---|---|---|---|---|
| | Carrier adhesion | Letter fattening | Halftone image surface roughness | Gradient | Image density | Other defects |
| Ex. 1 | ◎ | ◎ | ◎ | ◎ | 1.43 | |
| Ex. 2 | ◎ | ◎ | ◎ | ○ | 1.42 | |
| Ex. 3 | ○ | ◎ | ◎ | ◎ | 1.41 | |
| Ex. 4 | ◎ | ◎ | ◎ | ○ | 1.38 | |
| Ex. 5 | ○ | ○ | ◎ | ◎ | 1.40 | |
| Ex. 6 | ◎ | ◎ | ○ | ○ | 1.39 | Photoreceptor was slightly damaged |
| Ex. 7 | ○ | ◎ | ○ | ◎ | 1.44 | |
| Ex. 8 | ◎ | ◎ | ◎ | ○ | 1.39 | |
| Ex. 9 | ◎ | ○ | Δ | ○ | 1.42 | |
| Ex. 10 | ◎ | Δ | Δ | Δ | 1.43 | |
| Ex. 11 | ◎ | ◎ | ◎ | Δ | 1.42 | |
| Ex. 12 | ◎ | Δ | ○ | ○ | 1.37 | |
| Ex. 13 | ◎ | ◎ | ◎ | ◎ | 1.43 | |
| Ex. 14 | ◎ | ◎ | ○ | ○ | 1.42 | |
| Ex. 15 | ◎ | ◎ | ○ | Δ | 1.39 | |
| Ex. 16 | ◎ | ◎ | ◎ | ◎ | 1.41 | |
| Ex. 17 | ○ | ○ | ◎ | ○ | 1.42 | |
| Ex. 18 | ○ | ◎ | ○ | ○ | 1.38 | |
| Ex. 19 | ◎ | ◎ | ◎ | Δ | 1.38 | |
| Ex. 20 | ◎ | ○ | ◎ | ○ | 1.39 | |
| Com. Ex. 1 | Δ | ◎ | ◎ | ◎ | 1.39 | |
| Com. Ex. 2 | ◎ | X | ○ | X | 1.40 | |
| Com. Ex. 3 | Δ | ○ | ○ | Δ | 1.38 | |
| Com. Ex. 4 | ○ | ○ | Δ | Δ | 1.37 | |
| Com. Ex. 5 | X | Δ | ○ | ○ | 1.40 | |
| Com. Ex. 6 | X | ○ | Δ | Δ | 1.36 | |
| Com. Ex. 7 | ◎ | ○ | ○ | X | 1.37 | Much contamination in the apparatus |
| Com. Ex. 8 | ○ | ○ | ◎ | X | 1.35 | Photoreceptor was largely damaged |
| Com. Ex. 9 | Δ | Δ | Δ | Δ | 1.46 | |
| Com. Ex. 10 | X | ○ | Δ | Δ | 1.41 | |
| Com. Ex. 11 | Δ | X | ◎ | X | 1.33 | |

◎: Very good
○: Practically usable
Δ: Acceptable
X: Unusable

Finally, after 300,000 copies were produced, 1,000,000 copies were produced using the two-component developers in Examples 1, 14, and 16 to find that even the last images had high definition and resolution equivalent to those of the initial images.

This document claims priority and contains subject matter related to Japanese Patent Application No. 2003-025291 filed on Jan. 31, 2003, the contents of which are incorporated herein by reference.

Having now fully described the invention, it will be apparent to one of ordinary skill in the art that many changes and modifications can be made thereto without departing from the spirit and scope of the invention as set forth therein.

The invention claimed is:

1. A carrier comprising:

a magnetic core material; and a layer located on a surface of the magnetic core material, wherein the carrier satisfies the following relationships (1) to (3):

$$0.90 \leqq (\sigma a/\sigma b) < 1.00 \quad (1)$$

$$200 \leqq (\sigma b \cdot \rho c) \leqq 400 \quad (2)$$

$$10 \leqq (\sigma b/\rho c) \leqq 20 \quad (3),$$

wherein σb represents a magnetization (emu/g) of the carrier at 1,000 Oe, ρc represents a true specific gravity of the carrier, and σa represents a magnetization of the carrier determined by the following method including:

(1) magnetically holding the carrier on a cylindrical sleeve having a magnetic pole area located over a magnetic pole and having a peak magnetic flux density of 100 mT in a direction perpendicular to an axis of the cylindrical sleeve;

(2) rotating the cylindrical sleeve around the axis thereof for about 30 min;

(3) removing the carrier from the magnetic pole area by applying a force which is three times as much as a weight of the carrier in the direction perpendicular to the axis of the cylindrical sleeve; and (4) measuring a magnetization at 1,000 Oe to determine the magnetization σa, wherein the carrier has a weight-average particle diameter (D4) of about 25 to about 65 μm and includes carrier particles having a weight-average particle diameter not greater than about 12 μm in an amount not greater than about 0.3% by weight, wherein a ratio (D4/D1) between the weight-average particle diameter (D4) and a number-average particle diameter of the carrier (D1) is about 1 to about 1.3, and wherein an electric resistance R is about is about $1.0\times10^{9}$ to about $1.0\times10^{11}$ Ω·cm when an AC voltage represented by the following formula (4) is applied at a frequency of 1,000 Hz to a magnetic brush of the carrier is formed between parallel plate electrodes having a gap of d mm such that magnetic brush has a space occupancy of about 40%:

$$E(V)=250\times d \quad (4),$$

wherein d is 0.40±0.05 mm and E is a peak voltage.

2. The carrier of claim 1, wherein the carrier has an average surface vertical interval of about 0.1 to about 2.0 μm.

3. The carrier of claim 1, wherein the layer comprises a resin and an insulative inorganic particulate material.

4. The carrier of claim 1, wherein the magnetic core material includes a particulate ferrite.

5. The carrier of claim 1, wherein the magnetic core material includes a particulate material in which a magnetic material is dispersed in a resin.

6. A two-component developer comprising:

a carrier comprising:

a magnetic core material; and a layer located on a surface of the magnetic core material, wherein the carrier satisfies the following relationships (1) to (3):

$$0.90 \leqq (\sigma a/\sigma b) < 1.00 \quad (1)$$

$$200 \leqq (\sigma b \cdot \rho c) \leqq 400 \quad (2)$$

$$10 \leqq (\sigma b/\rho c) \leqq 20 \quad (3),$$

wherein σb represents a magnetization (emu/g) of the carrier at 1,000 Oe, ρc represents a true specific gravity of the carrier, and σa represents a magnetization of the carrier determined by the following method including:

(1) magnetically holding the carrier on a cylindrical sleeve having a magnetic pole area located over a magnetic pole and having a peak magnetic flux density of 100 mT in a direction perpendicular to an axis of the cylindrical sleeve;

(2) rotating the cylindrical sleeve around the axis thereof for about 30 min;

(3) removing the carrier from the magnetic pole area by applying a force which is three times as much as a weight of the carrier in the direction perpendicular to the axis of the cylindrical sleeve; and (4) measuring a magnetization at 1,000 Oe to determine the magnetization σa, wherein the carrier has a weight-average particle diameter (D4) of about 25 to about 65 μm and includes carrier particles having a weight-average particle diameter not greater than about 12 μm in an amount not greater than about 0.3% by weight, wherein a ratio (D4/D1) between the weight-average particle diameter (D4) and a number-average particle diameter of the carrier (D1) is about 1 to about 1.3, and wherein an electric resistance R is about $1.0\times10^{9}$ to about $1.0\times10^{11}$ Ω·cm when an AC voltage represented by the following formula (4) is applied at a frequency of 1,000 Hz to a magnetic brush of the carrier is formed between parallel plate electrodes having a gap of d mm such that magnetic brush has a space occupancy of about 40%:

$$E(V)=250\times d \quad (4),$$

wherein d is 0.40±0.05 mm and E is a peak voltage; and a toner comprising:

a binder resin; and a colorant.

7. The two-component developer of claim 6, wherein the two-component developer comprises the toner in an amount of about 2 to about 12% by weight.

8. The two-component developer of claim 6, wherein the toner further comprises a release agent.

9. The two-component developer of claim 6, wherein the toner has a weight-average particle diameter of about 4 to about 10 μm.

10. A carrier comprising:

a magnetic core material; and a layer located on a surface of the magnetic core material, wherein the carrier satisfies the following relationships (1) to (3):

$$0.90 \leqq (\sigma a/\sigma b) < 1.00 \quad (1)$$

$$200 \leqq (\sigma b \cdot \rho c) \leqq 400 \quad (2)$$

$$10 \leqq (\sigma b/\rho c) \leqq 20 \quad (3),$$

wherein σb represents a magnetization (emu/g) of the carrier at 1,000 Oe, ρc represents a true specific gravity of the carrier, and σa represents a magnetization of the carrier determined by the following apparatus including:

(1) means for magnetically holding the carrier on a cylindrical sleeve having a magnetic pole area located over a magnetic pole and having a peak magnetic flux density of 100 mT in a direction perpendicular to an axis of the cylindrical sleeve;

(2) means for rotating the cylindrical sleeve around the axis thereof for about 30 min;

(3) means for removing the carrier from the magnetic pole area by applying a force which is three times as much as a weight of the carrier in the direction perpendicular to the axis of the cylindrical sleeve; and (4) means for measuring a magnetization at 1,000 Oe to determine the magnetization σa, wherein the carrier has a weight-average particle diameter (D4) of about 25 to about 65 μm and includes carrier particles having a weight-average particle diameter not greater than about 12 μm in an amount not greater than about 0.3% by weight, wherein a ratio (D4/D1) between the weight-average particle diameter (D4) and a number-average particle diameter of the carrier (D1) is about 1 to about 1.3, and wherein an electric resistance R is about $1.0\times10^{9}$ to about $1.0\times10^{11}$ Ω·cm when an AC voltage represented by the following formula (4) is applied at a frequency of 1,000 Hz to a magnetic brush of the carrier is formed between parallel plate electrodes having a gap of d mm such that magnetic brush has a space occupancy of about 40%:

$$E(V)=250\times d \quad (4),$$

wherein d is 0.40±0.05 mm and E is a peak voltage.

11. The carrier of claim 10, wherein the carrier has an average surface vertical interval of about 0.1 to about 2.0 μm.

12. The carrier of claim 10, wherein the layer comprises a resin and an insulative inorganic particulate material.

13. The carrier of claim 10, wherein the magnetic core material includes a particulate ferrite.

14. The carrier of claim 10, wherein the magnetic core material includes a particulate material in which a magnetic material is dispersed in a resin.

15. The carrier of claim 1, wherein the σb of the carrier at 1,000 Oe is measured by a multi-sample rotational magnetization measurer.

16. The carrier of claim 10, wherein the σb of the carrier at 1,000 Oe is measured by a multi-sample rotational magnetization measurer.

* * * * *